United States Patent [19]

Herrington et al.

[11] Patent Number: 4,860,267

[45] Date of Patent: Aug. 22, 1989

[54] METHOD FOR PROVIDING A SIGNAL TO PREPARE WASTE MATERIALS FOR COLLECTION AND WASTE CONTAINERS INCORPORATING AN ALARM DEVICE

[75] Inventors: Fox J. Herrington, Holcomb; Eric A. St. Phillips, Fairport, both of N.Y.

[73] Assignee: Mobil Oil Corporation, New York, N.Y.

[21] Appl. No.: 232,050

[22] Filed: Aug. 15, 1988

[51] Int. Cl.[4] ..... G04B 47/00; B65D 90/00

[52] U.S. Cl. ..... 368/10; 220/1 T

[58] Field of Search ..... 368/10, 107–113; 220/1 T

[56] References Cited

U.S. PATENT DOCUMENTS

| | | | |
|---|---|---|---|
| 3,938,433 | 2/1976 | Borum | 100/51 |
| 4,188,622 | 2/1980 | Miller | 116/81 |
| 4,603,625 | 8/1986 | Brown | 100/53 |

*Primary Examiner*—Vit W. Miska

*Attorney, Agent, or Firm*—Alexander J. McKillop; Charles J. Speciale; Michael J. Mlotkowski

[57] ABSTRACT

A waste container that utilizes a clock-timer circuit to actuate an alarm to remind a user to empty the container and prepare the contents for subsequent collection. The clock-timing circuit and signalling means can be an integral part of the container or affixed to the container by an adhesive or any other suitable fastening means. A preferred apparatus comprises a waste container, an audible signalling means, a clock-timer circuit for actuation of the signalling means at a predetermined time corresponding to the interval between trash collection service pick-ups and a housing for mounting the timing circuit and signalling means within. Also furnished is a method for providing a signal to prepare waste materials for collection comprising the steps of setting a clock-timer circuit affixed to a waste container for a predetermined period of time, providing an actuation pulse upon the expiration of the period of time and generating an alarm through the use of a signalling means affixed to the waste container.

30 Claims, 2 Drawing Sheets

METHOD FOR PROVIDING A SIGNAL TO PREPARE WASTE MATERIALS FOR COLLECTION AND WASTE CONTAINERS INCORPORATING AN ALARM DEVICE

BACKGROUND OF THE INVENTION

Various containers for waste materials are in use in the kitchen, bathroom, bedroom, garage, workplace, office and the like. As a result of today's active lifestyles, the emptying of these various waste containers in preparation for trash collection day is all too often neglected. It is desirable, therefore, to provide a waste container that utilizes a clock-timing circuit to actuate an audible alarm or otherwise produce a signal to the user as a reminder to empty the container and prepare the trash for subsequent collection. Also it is desirable to furnish a method to provide a signal to prepare waste materials for collection that incorporates the steps of setting a clock-timing circuit affixed to a waste container for a predetermined period of time, providing an actuation pulse upon the expiration of the period of time and generating an alarm through the use of a signalling means affixed to the container. The predetermined period of time is selected with reference to a subsequent trash collection service pick-up.

SUMMARY OF THE INVENTION

This invention relates to a container for waste products having a clock-timing circuit acting in cooperation with an audible and/or visual signalling means affixed or integral to said container to serve as a reminder to prepare waste materials for collection.

Also, this invention furnishes a method for providing a signal to prepare waste materials for collection. A clock-timer circuit affixed to a container for waste materials is set to a predetermined period of time, such time period being selected with reference to a subsequent trash collection service pick-up. An actuation pulse is provided upon the expiration of the time period. An alarm is generated through the use of a signalling means affixed to said container in response to the actuation pulse.

DETAILED DESCRIPTION

Figure 1:
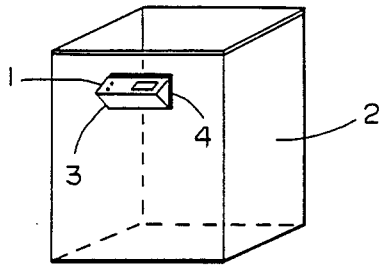
FIG. 1 is a view in perspective of a waste container having a clock-timing circuit and signalling means installed within a housing and affixed to the wall of the container through the use of an adhesive material.

The waste containers of this invention may be of any size, shape or configuration, and be designed for domestic, office or any other use. There is no limitation on the material used to construct the container; any of the well-known materials such as any plastic, wood or metal may be selected.

The waste containers of this invention provide a clock-timing circuit for triggering the actuation of an audible and/or visual alarm at a predetermined time. In its simplest form, containers of this invention will provide a single reset button which, upon depression, will reset the clock-timing circuit to trigger the alarm or signalling means every seven days (approximately 160 hours). Alternate embodiments of this invention may provide means for permitting the varying or programming of the time of the next actuation of the alarm or signalling means, so that the invention is suitable to users in locations where trash collection is provided more frequently than once per week or where an alternate collection schedule is in effect due to a holiday, for example. These alternate embodiments may include, but are not limited to, setting the alarm feature on the basis of the number of hours or days between collections. Another embodiment may also provide a low-cost digital clock readout or a readout of the time remaining until the next trash service pick-up.

Several different types of signalling means are useful in this invention. In one embodiment, an audible alarm, preferably of a low cost, low power requirement type, is envisioned. Upon reaching the expiration of the predetermined time until the next trash collection service, the alarm may be triggered by the clock-timing circuit to sound periodically until being turned off or reset by the user. Time periods between alarm soundings envisioned as being useful in this invention include one minute, one hour and any fraction of an hour, bi-hourly, etc. A constant-on alarm may also be provided as part of this invention. In another embodiment of this invention, a visual alarm or signalling means may be utilized. Upon reaching the expiration of the preset time, the visual signalling means will be actuated and either remain constantly on or flash periodically. The visual alarm may be provided by a light emitting diode (LED), an incandescent light or an illuminated message, such as: "Trash Day". Additionally, a mechanical flag may be utilized to provide the visual alarm. Still another embodiment of this invention would incorporate a combination of audible and visual alarms. A further embodiment would incorporate means to empty the container upon the expiration of the predetermined time period.

A method is also provided for producing a signal to prepare waste materials for collection which comprises the steps of setting a clock-timer circuit affixed to a container for waste materials to a predetermind time period, providing an actuation pulse upon the expiration of the time period and generating an alarm through the use of a signalling means affixed to the waste container in response to the actuation pulse provided by the clock-timing circuit. The predetermined time period is selected with reference to a subsequent trash collection service pick-up and may be preset by the fabricator of the clock-timer circuit or set by the user of the method through the use of any means adapted to that purpose. Also within the scope of this method is the additional step of emptying the container upon the expiration of the predetermined time period. Any of the embodiments of the waste containers of the present invention described herein are envisioned to be useful and applicable in carrying out the steps of this method.

Figure 4:
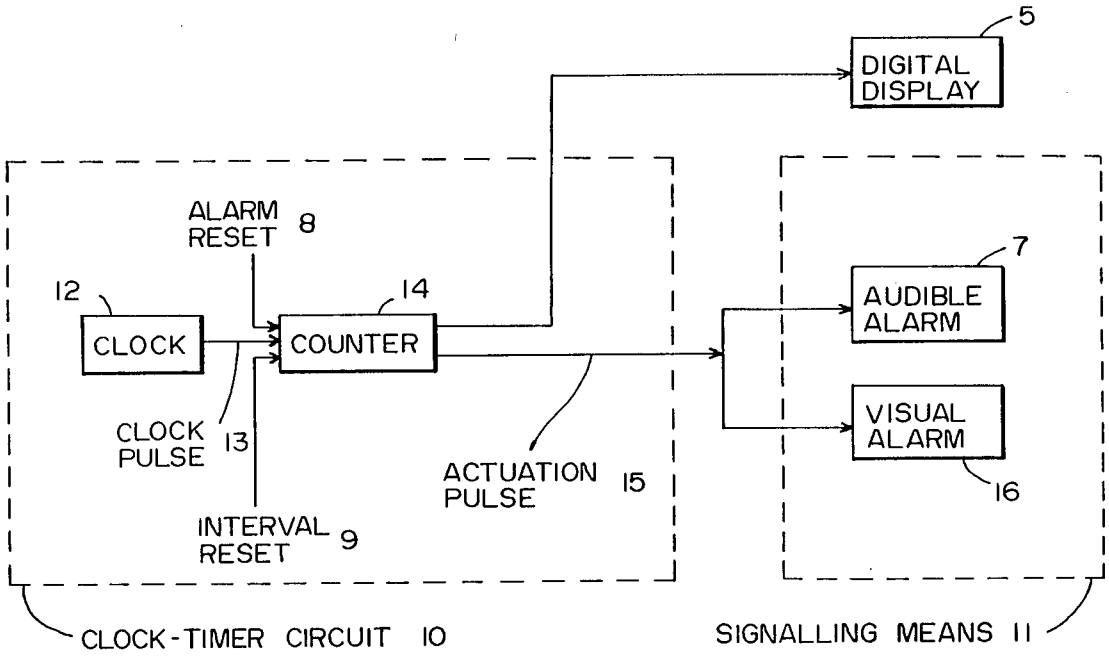
FIG. 4 is a block diagram illustrating the cooperation of the component parts comprising an embodiment of a waste container alarm device.

FIG. 1 shows a waste container 2 wherein a waste container alarm device 1, comprised of the clock-timing circuit 10 of FIG. 4 and the signalling means 11 of FIG.

4, is mounted within a housing 3 and affixed by adhesive means 4, which may be either a glue-based substance or a pressure sensitive tape. Other fastening means such as screws or nuts and bolts would also be useful in this embodiment.

Figure 2:
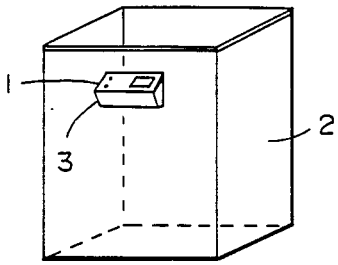
FIG. 2 is a view in perspective of a waste container having a clock-timing circuit and signalling means mounted within a housing which is an integral part of said container.

FIG. 2 shows another embodiment of this invention wherein the housing 3 of the waste container alarm device 1 is an integral part of the waste container 2 itself; with the components mounted within said housing.

Figure 3:
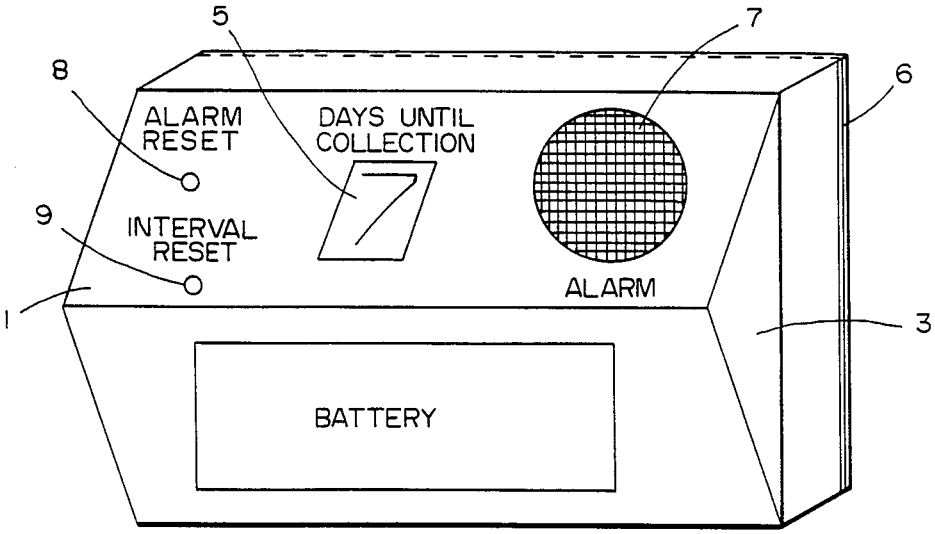
FIG. 3 is a close-up view of the waste container's alarm device having a clock-timing circuit and signalling means mounted within a housing. An audible signalling means is utilized for this example.

FIG. 3 provides a close-up view of a waste container alarm device 1 which utilizes an audible alarm 7 actuated by the clock-timing circuit 10 mounted within the housing 3 having a first button 8 for resetting the timing circuit, a second button 9 for resetting the number of days between trash collections (interval reset), and a digital display 5 for indicating the number of days until the next trash collection. The digital display may also be used in the setting of the number of days until the next trash collection. The waste container alarm device may be battery powered and may be affixed to any container through the use of a pressure sensitive tape 6 mounted to the rear of the housing.

FIG. 4 provides a block diagram illustrating the cooperation of the component parts comprising a waste container alarm device having the features indicated therein. The clock-timer circuit 10 utilizes a clock 12 to provide pulses 13 to be counted by a counter 14. When the appropriate number of clock pulses, corresponding to a predetermined time selected with reference to a subsequent trash service pick-up, have been counted, an actuation pulse 15 is sent to actuate the signalling means 11. Upon reacting to the signalling means, the user may deactivate the signalling means and reinitiate the counter by actuating the alarm reset button 8. The predetermined time may be changed to a different interval through the use of the interval reset button 9. The time remaining until the next actuation of the signalling means may be displayed on the digital display 5. The signalling means of FIG. 4 utilizes both an audible alarm 7 and a visual alarm 16. The visual alarm 16 may be an illuminated light or a mechanical flag.

The invention and its broader aspects is not limited to the specific details shown and described. Although the invention has been described with preferred embodiments, it is to be understood that modifications and variations may be made without departing from the spirit and scope of the invention as those skilled in the art will readily understand.

What is claimed is:

1. A method for producing a signal to prepare waste materials for collection, comprising the steps of:

(a) setting a clock-timer circuit affixed to a container for waste materials to a predetermined time period, wherein said time period is determined with reference to a subsequent trash collection service pick-up;

(b) providing an actuation pulse upon the expiration of said time period; and (c) generating a signal through the use of a signalling means affixed to said container in response to said actuation pulse.

2. A method as recited in claim 1, wherein the step of generating a signal in response to said actuation pulse includes providing an audible alarm.

3. A method as recited in claim 1, wherein the step of generating a signal in response to said actuation pulse includes providing an illuminated alarm.

4. A method as recited in claim 1, wherein the step of generating a signal in response to said actuation pulse includes pulsing an illuminated alarm.

5. A method as recited in claim 1, wherein the step of generating a signal in response to said actuation pulse includes raising a mechanical flag.

6. A method as recited in claim 1, wherein the step of generating a signal in response to said actuation pulse includes providing both an audible alarm and an illuminated alarm.

7. A method as recited in claim 1, wherein the step of generating a signal in response to said actuation pulse includes providing an audible alarm and raising a mechanical flag.

8. A method as recited in claim 1, further comprising the step of periodically repeating step (c).

9. A method as recited in claim 1, further comprising the step of emptying the container upon the expiration of said time period.

10. A method as recited in claim 1, further comprising the step of displaying the time period remaining until the trash collection service pick-up.

11. A method as recited in claim 1, further comprising the step of programming said clock-timer circuit to vary and establish said predetermined time period.

12. A method as recited in claim 1, further comprising the step of affixing said clock-timer circuit and signalling means to said container, wherein said clock-timer circuit and signalling means are mounted within a housing and said step of affixing is accomplished by means attached to said housing, and wherein the affixing means includes a strip of material having a pressure sensitive adhesive on the outwardly directed surface thereof.

13. A method as recited in claim 1, wherein the clock-timer circuit and signalling means are mounted within a housing which is adhered to said container.

14. A method as recited in claim 1, wherein the clock-timer circuit and signalling means are mounted within a housing integral to said container.

15. An apparatus for waste products comprising:

(a) a waste container;

(b) a signalling means affixed to said container to alert a user to prepare waste materials for collection; and (c) a clock-timer circuit affixed to said container for actuation of said signalling means at a predetermined time, wherein the predetermined time is determined with reference to a subsequent trash collection service pick-up.

16. An apparatus in accordance with claim 15, wherein said clock-timer circuit is comprised of a clock and a counter for counting pulses provided by said clock.

17. An apparatus in accordance with claim 15, wherein the clock-timer circuit and signalling means are mounted within a housing which is adhered to said container.

18. An apparatus according to claim 17, wherein adherance of said housing to said container is accomplished by means affixed to said housing, wherein the means includes a strip of material having a pressure sensitive adhesive on the outwardly directed surface thereof.

19. An apparatus in accordance with claim 15, wherein said clock timing circuit and signalling means are contained within a housing integral to said container.

20. An apparatus in accordance with claim 15, wherein said container is a synthetic plastic material.

21. An apparatus in accordance with claim 15, wherein said container is metal.

22. An apparatus in accordance with claim 15, wherein said container is wood.

23. An apparatus in accordance with claim 15, wherein the predetermined time for actuation of said signalling means may be varied and established by a means adapted to permit user programming.

24. An apparatus in accordance with claim 23, further comprising a numeric display to indicate the time remaining until the next trash collection service pick-up.

25. An apparatus in accordance with claim 15, wherein said signalling means includes means for providing an audible alarm.

26. An apparatus in accordance with claim 15, wherein said signalling means includes means for providing an illuminated alarm.

27. An apparatus in accordance with claim 15, wherein said signalling means includes a mechanical flag.

28. An apparatus in accordance with claim 15, wherein said signalling means includes both means for providing an audible alarm and an illuminated alarm.

29. An apparatus in accordance with claim 15, wherein said signalling means includes both means for producing an audible alarm and raising a mechanical flag.

30. An apparatus in accordance with claim 15, wherein said signalling means includes means for providing multiple periodic alarms.

* * * * *